US007874629B2

(12) United States Patent
Mizutani

(10) Patent No.: US 7,874,629 B2
(45) Date of Patent: Jan. 25, 2011

(54) PRINTING APPARATUS, A METHOD TO INDICATE NECESSITY OF EXCHANGING EXCHANGEABLE PARTS, AND A COMPUTER USABLE MEDIUM THEREFOR

(75) Inventor: Toshiaki Mizutani, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 360 days.

(21) Appl. No.: 12/219,675

(22) Filed: Jul. 25, 2008

(65) Prior Publication Data

US 2009/0056582 A1 Mar. 5, 2009

(30) Foreign Application Priority Data

Aug. 28, 2007 (JP) ..... 2007-220843

(51) Int. Cl.
*B41J 3/00* (2006.01)

(52) U.S. Cl. ..... 347/4; 347/104; 347/16

(58) Field of Classification Search ..... 347/4
See application file for complete search history.

(56) References Cited

U.S. PATENT DOCUMENTS 6,883,911 B2 * 4/2005 Niimi et al. ..... 347/104
2004/0179081 A1 9/2004 Nimi et al.
2006/0152568 A1 7/2006 Niimi et al.
2006/0203069 A1 9/2006 Niimi et al.

FOREIGN PATENT DOCUMENTS

JP A-2004-291399 10/2004

* cited by examiner

*Primary Examiner*—Matthew Luu
*Assistant Examiner*—Brian J Goldberg
(74) *Attorney, Agent, or Firm*—Oliff & Berridge, PLC

(57) ABSTRACT

A printing apparatus for forming an image on fabric is provided. The printing apparatus includes a plurality of exchangeable fabric holders, a recording head, which is driven according to printable data including image information representing the image to be printed and holder information concerning a type of the fabric holder to be used for forming the image, an obtaining unit to obtain the printable data from external environment, a storage unit with a storage area to store the holder information extracted from the printable data, an examination unit to examine as to whether the holder information for a current printing operation is identical with the holder information for a previous printing operation stored in the storage area, and an indication unit, which indicates a result of the examination obtained by the examination unit to notify a user of necessity of exchanging the fabric holders.

8 Claims, 6 Drawing Sheets

PRINTING APPARATUS, A METHOD TO INDICATE NECESSITY OF EXCHANGING EXCHANGEABLE PARTS, AND A COMPUTER USABLE MEDIUM THEREFOR

CROSS REFERENCE TO RELATED APPLICATION

This application claims priority from Japanese Patent Application No. 2007-220843, filed on Aug. 28, 2007, the entire subject matter of which is incorporated herein by reference.

BACKGROUND

1. Technical Field

An aspect of the present invention relates to a printing apparatus for fabric printing, capable of notifying a user of necessity of exchanging fabric holders, a method to notify the user of the necessity, and a computer usable medium therefor.

2. Related Art

Printing apparatuses capable of forming images on fabric held on a platen by having inks ejecting from an inkjet head onto the fabric have been known. Such a printing apparatus has a platen with a retainer surface to hold the recording medium (i.e., the fabric) plane thereon, over which an operator sets the fabric for a printing operation. The fabric can be in various forms; for example, a T-shirt may be used as a recording medium. In order to support T-shirts in various sizes, the printing apparatus can be provided with a plurality of types of platens. The platens may include a smaller platen for holding the T-shirt at a specific portion, in which a pocket is provided, so that a pattern can be printed on the pocket. Such a printing apparatus is disclosed in Japanese Patent Provisional Publication No. 2004-291399, for example.

SUMMARY

When a platen of a designated type, which is designated according to image data to be printed, is not mounted in the printing apparatus and an incorrect platen is mounted instead, the printing operation may not be correctly performed, and the fabric set on the incorrect platen can be ruined to be wasted. Therefore, in order to avoid such waste, a mechanism to check as to whether the type of the platen being mounted corresponds to the platen of the designated type may be provided. However, such a mechanism requires specific components, such as a sensor to detect the type of the platen being mounted, and an entire configuration of the printing apparatus can be complicated.

In view of the above, the present invention is advantageous in that a printing apparatus for fabric, in which necessity of exchanging fabric holders can be notified, a method to notify the necessity, and a computer usable medium therefor are provided.

According to an aspect of the invention, a printing apparatus for forming an image on a piece of fabric is provided. The printing apparatus includes a plurality of types of exchangeable fabric holders, one of which is selectively mounted in the printing apparatus to hold the fabric, a recording head, which is driven to eject ink onto the fabric according to printable data, wherein the printable data including image information representing the image to be printed and holder information concerning a type of the fabric holder to be used for forming the image in the printing apparatus, an obtaining unit to obtain the printable data from external environment, a storage unit with a storage area to store the holder information extracted from the printable data, an examination unit to examine as to whether the holder information included in printable data to be used in a current printing operation is identical with the holder information extracted from the printable data used in a previous printing operation and stored in the storage area, and an indication unit, which indicates a result of the examination obtained by the examination unit to notify a user of the printing apparatus of necessity of exchanging the fabric holders when the fabric holder to be used in the current printing operation is different from the fabric holder used in the previous printing operation.

According to an aspect of the invention, a method to provide indication concerning necessity of replacing a fabric holder used in a previous printing operation with a fabric holder to be used in a current printing operation to a user of a printing apparatus having a plurality of types of exchangeable fabric holders is provided. The method includes executing steps of obtaining printable data, which includes image information representing an image to be printed and holder information concerning a type of the fabric holder to be used for forming the image in the printing apparatus, from external environment, extracting the holder information from the printable data to store in a storage area of a storage unit, examining as to whether the holder information included in the printable data to be used in the current printing operation is identical with the holder information extracted from the printable data used in a previous printing operation and stored in the storage area, and indicating a result of the examination to notify the user of necessity of exchanging the fabric holders when the fabric holder to be used in the current printing operation is different from the fabric holder used in the previous printing operation.

According to still another aspect of the invention, a computer usable medium including computer readable instructions to control a printing apparatus having a plurality of types of exchangeable fabric holders to provide a user with indication concerning necessity of exchanging the fabric folders is provided. The computer readable instructions to control the printing apparatus include instructions to execute steps of obtaining printable data, which includes image information representing an image to be printed and holder information concerning a type of the fabric holder to be used for forming the image in the printing apparatus, from external environment, extracting the holder information to store in a storage area of a storage unit, examining as to whether the holder information included in the printable data to be used in a current printing operation is identical with the holder information extracted from the printable data used in a previous printing operation and stored in the storage area, and indicating a result of the examination to notify the user of necessity of exchanging the fabric holders when the fabric holder to be used in the current printing operation is different from the fabric holder used in the previous printing operation.

According to the above configurations, the types of the fabric holders are compared to examine consistency so that the user can be notified of the result, i.e., consistency or inconsistency of the fabric holders in the current printing operation and the previous printing operation. Specifically when the fabric holders are inconsistent, the user can be notified of necessity of exchanging the fabric holders. Therefore, an erroneous printing operation with an incorrect fabric holder can be effectively prevented without specific device such as a sensor to recognize the type of the fabric holder.

BRIEF DESCRIPTION OF THE ACCOMPANYING DRAWINGS

Figure 3:
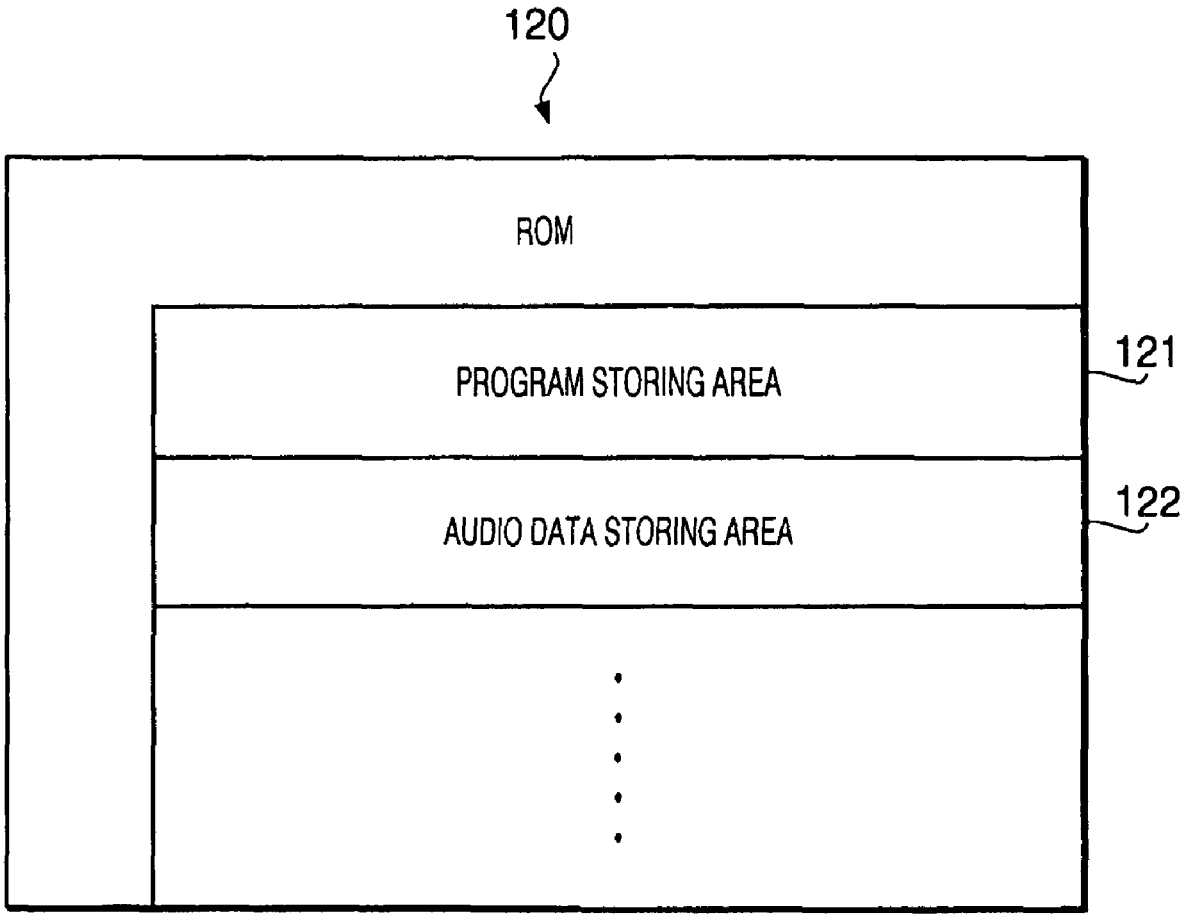

FIG. 3 schematically illustrates storage areas in a ROM 120 of the fabric printer 1 according to the embodiment of the present invention.

Figure 4:
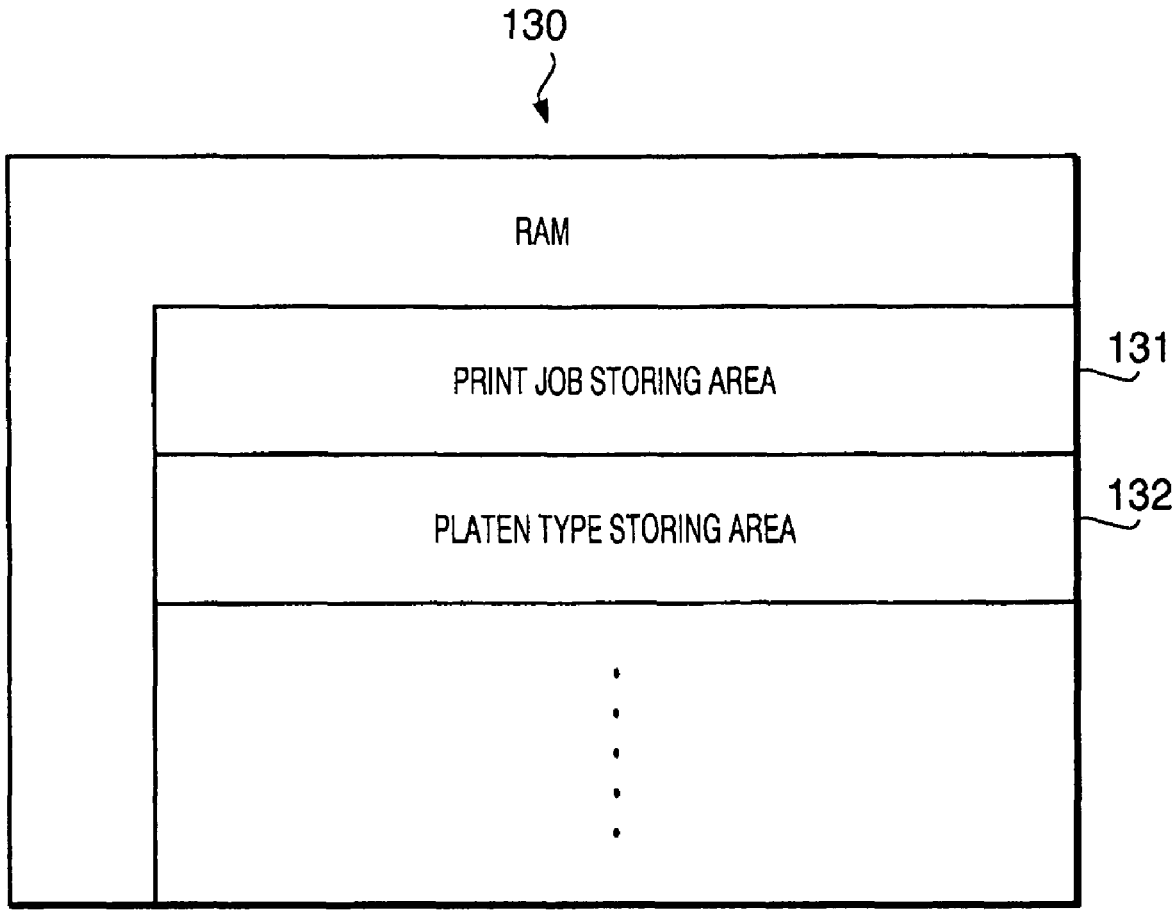

FIG. 4 schematically illustrates storage areas in a RAM 130 of the fabric printer 1 according to the embodiment of the present invention.

Figure 5:
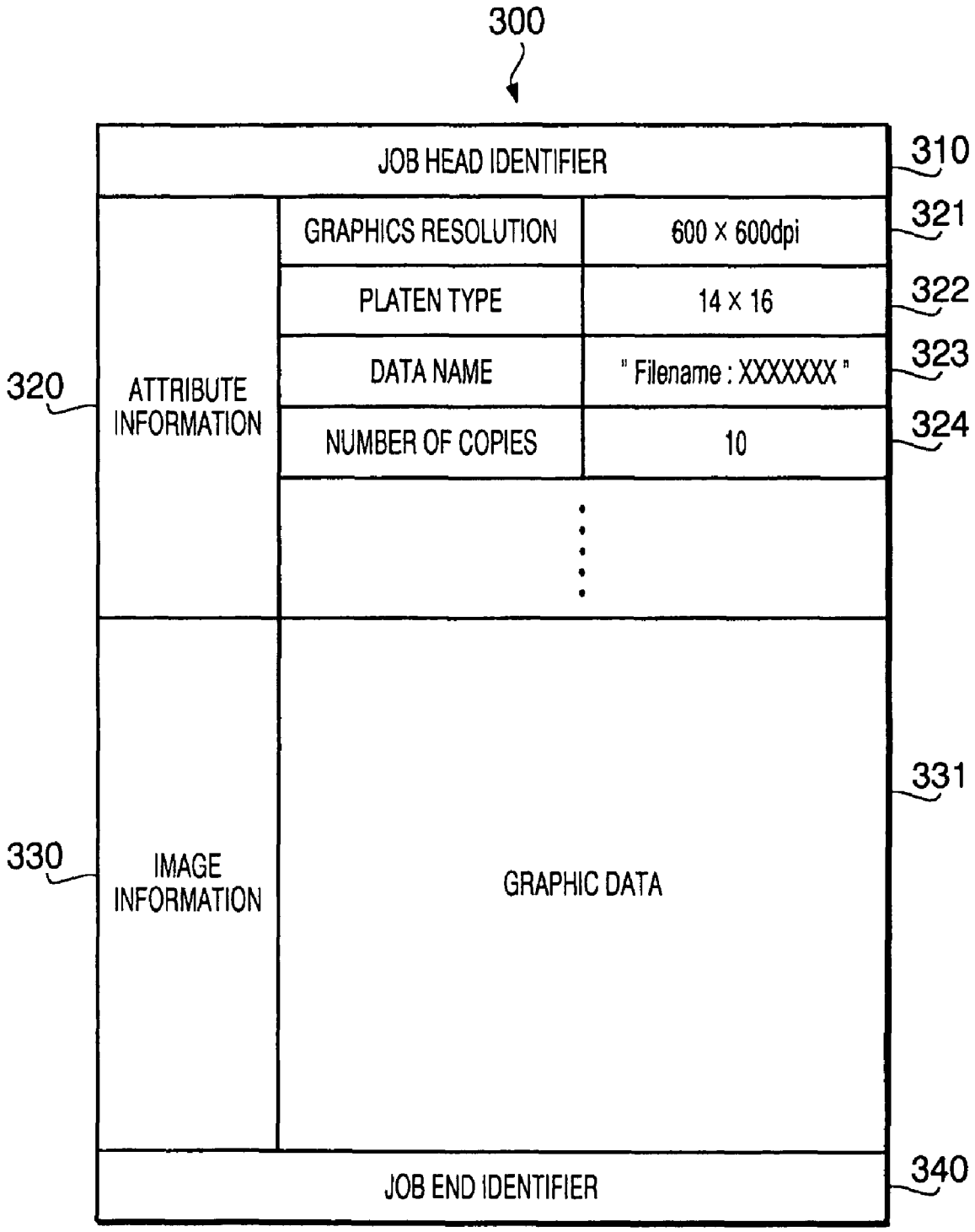

FIG. 5 schematically illustrates a data structure of a print job 300 to be processed in the fabric printer 1 according to the embodiment of the present invention.

Figure 6:
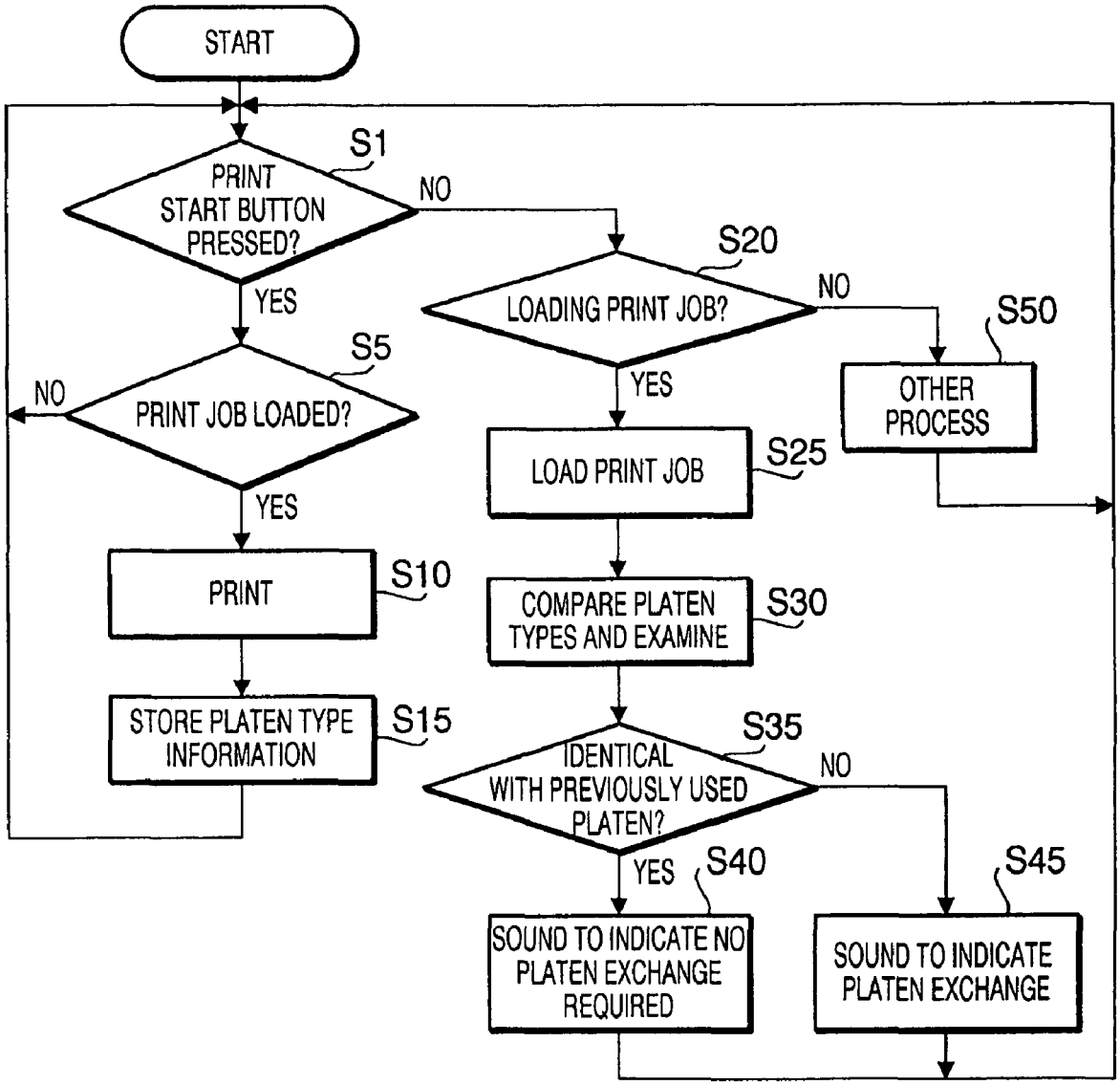

FIG. 6 is a flowchart to illustrate a printing process of the fabric printer 1 according to the embodiment of the present invention.

DETAILED DESCRIPTION

Hereinafter, an embodiment according to an aspect of the present invention will be described with reference to the accompanying drawings.

Figure 1:
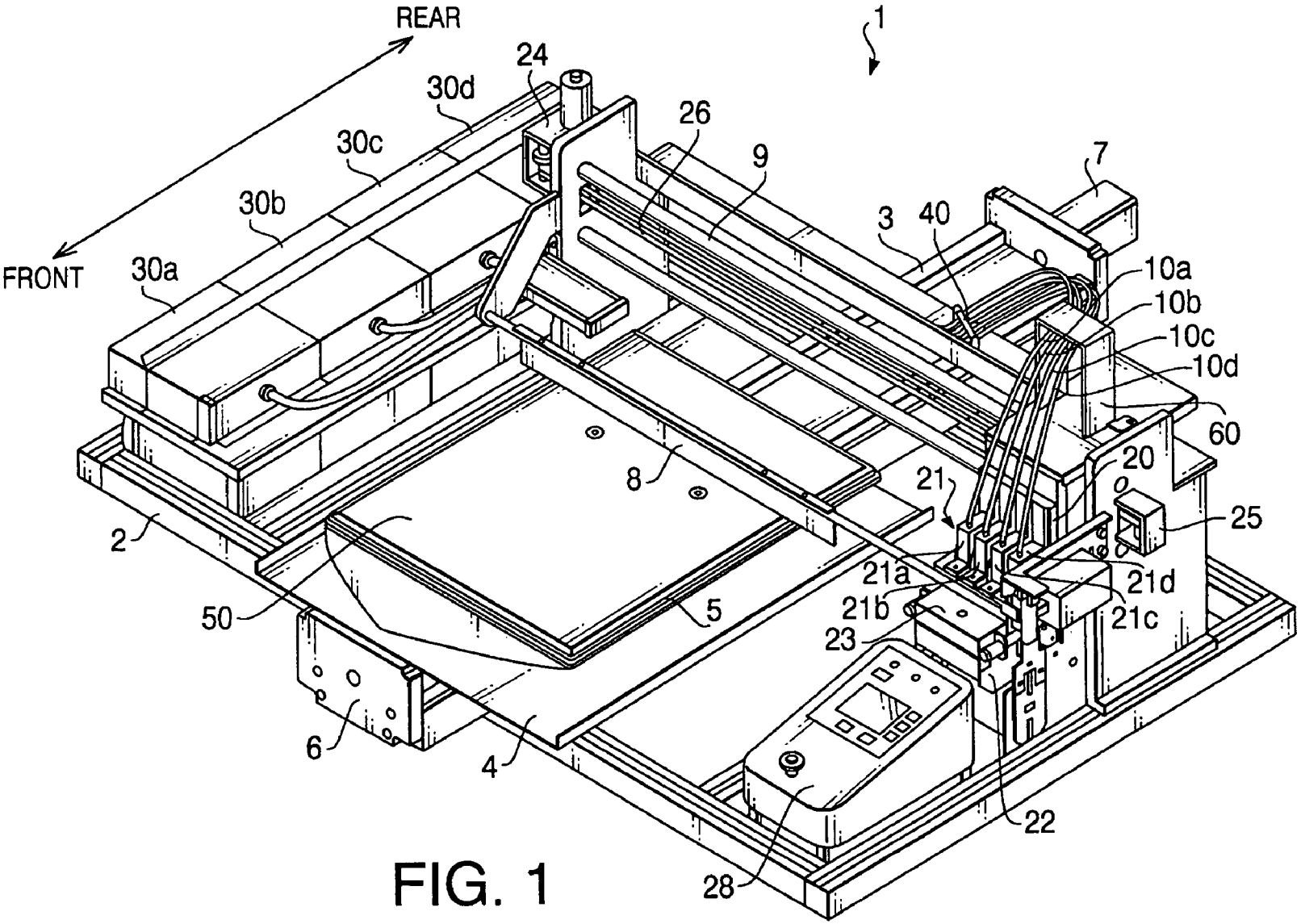
FIG. 1 is a perspective view of an entire fabric printer 1 according to an embodiment of the present invention.

FIG. 1 is a perspective view of an entire fabric printer 1 according to an embodiment of the present invention. In the present embodiment, the fabric printer 1 is an inkjet printer to form an image on fabric based on image data transmitted from a personal computer (PC) 200 (see FIG. 2). The fabric printer 1 according to the embodiment of the present invention uses four color inks, which are in C (cyan), M (magenta), Y (yellow), and K (black), and the images formed by the fabric printer 1 is reproduced in the CMYK.

As shown in FIG. 1, the fabric printer 1 includes a substantially box-shaped chassis 2 with two rails 3 aligned in parallel with a front-rear direction, as indicated by an arrow in FIG. 1, at an approximate center of a bottom surface thereof. The rails 3 are supported by bases (not shown) which are positioned perpendicularly with respect to the bottom surface of the chassis 2. The rails 3 support a plate as a platen base (not shown) which is movable in the front-rear direction of the chassis 2 along the rails 3. Further, the platen base is provided with a platen mount (not shown) that extends perpendicularly with respect to the platen base at a substantial center of the platen base. An exchangeable platen 5 is set on top of the platen mount.

The platen 5 is a substantially rectangular-shaped plate and detachably attached to the platen mount with longer sides thereof aligned in parallel with the front-rear direction of the chassis 2, and fabric (not shown) as a recording medium is placed on the platen 5. A top surface of the platen 5 is provided with a slip stopper sheet 50, which is made of, for example, a cotton cloth, to prevent the fabric tensely placed on the platen 5 from being displaced during the printing operation. It is to be noted in the present embodiment that only one platen 5 is shown in FIG. 1; however, the fabric printer 1 is provided with a plurality of types of exchanging platens which can be similarly mounted in the fabric printer 1.

In a position between the platen 5 and the platen base is provided a tray 4, which is fixed to the platen mount and has a bottom surface being substantially parallel with the top surface of the platen 5. The tray 4 is at least substantially larger than the platen 5 in a plan view. The tray 4 is provided so that a remaining part of the fabric other than the area to be printed such as sleeves of a T-shirt is received thereby and prevented from hanging over the bottom surface of the chassis 2 when the T-shirt is set on the platen 5. The fabric printer 1 is provided with a plurality of shapes of exchangeable platens, so that a suitable shape of platen 5 among the plurality of platens is used depending on a size of an image to be printed and characteristics of the fabric.

A platen drive mechanism 6 includes the rails 3, along which the platen base is carried in the front-rear direction of the chassis 2 by a platen drive motor 7, as the platen motor 7 is provided at a rear end of the platen drive mechanism 6. As a drive shaft of the platen drive motor 7 and a pulley (not shown) provided in vicinity of front ends of the rails 3 are bound with a drive belt (not shown), the platen base fixed to the drive belt is reciprocated along the rails 3 by drive force generated by the platen drive motor 7. It is to be noted that in the present embodiment a position of the platen 5 when the platen 5 is at the front ends of the rails 3 is referred to as a ready position wherein the platen 5 is located when the printing operation is started. Further, a side wherein the front ends of the rails 3 are located is referred to as a downstream side; while a side wherein the rear ends of the rails 3 are located is referred to as an upstream side.

At an approximate center of the chassis 2 in the front-rear direction, above the platen 5, a guide rail 9 to guide a carriage 20 with inkjet heads 21*a*-21*d* being mounted is provided. In the vicinity of a left-hand end of the guide rail 9, a carriage motor 24 to drive the carriage 20 is provided, while a pulley 25 is provided in the vicinity of a right-hand end of the guide rail 9. Further, a carriage belt 26 is drawn between the carriage motor 24 and the pulley 25 under the guide rail 9. The carriage belt 26 is fixed to a rear surface of the carriage 20 so that the carriage 20 is reciprocated along the guide rail 9, which is coupled to the carriage 20 at a coupling portion (not shown) being fixed to the rear surface of the carriage 20 when the carriage motor 24 is activated. The carriage motor 24 is a DC motor, of which position on the guide rail 9 is detected by a linear encoder (not shown) provided to the guide rail 9.

In the fabric printer 1 according to the present embodiment, cyan ink, magenta ink, yellow ink, and black ink are used for image printing. Therefore, four ink cartridge storage units 30*a*-30*d*, wherein ink cartridges having the inks therein are detachably attached, are aligned on the left-hand side of the fabric printer 1. The ink cartridge units 30*a*-30*d* respectively include ink cartridges (not shown), each of which contains black ink, cyan ink, magenta ink, and yellow ink therein.

Each of the ink cartridge storage units 30*a*-30*d* is connected to one of the inkjet heads 21*a*-21*d* by ink supplying tubes 10*a*-10*d* so that the inks of the four colors stored in the ink cartridges are supplied to each channel of the inkjet heads 21*a*-21*d* passing under a guiding member 40 and a tube supporting member 60. The ink supplying tubes 10*a*-10*d* are flexible tubes which can be bent and twisted to a certain extent according to the movements of the carriage 20. The guiding member 40 holds the ink supplying tubes 10*a*-10*d* behind the carriage 20. The tube supporting member 60 holds the ink supplying tubes 10*a*-10*d* as well is provided at an upper surface of the carriage 20.

The carriage 20 is provided with the four piezoelectric inkjet heads 21*a*-21*d*. Each of the inkjet heads 21*a*-21*d* is provided with a plurality of (for example, 128) ejection channels (not shown) through which the ink is conveyed. Each of the channels is provided with a piezoelectric actuator (not shown), which is activated individually, to eject an ink drop downward onto the recording medium (i.e., the fabric) from ejection nozzles (not shown) that are open at nozzle surfaces of the inkjet heads 21*a*-21*d*. Thus, the black, cyan, magenta, and yellow inks stored in the ink cartridge storage units 30*a*-30*d* respectively are supplied to the inkjet heads 21*a*-21*d* through the ink supplying tubes 10*a*-10*d* and ejected from the ejection nozzles.

At a position corresponding to the carriage 20 being carried to the right-hand end of the guide rail 9, a purge unit 22 with a suction cap 23, which can be closely attached to and separated from the nozzle surfaces is provided. The purge unit 22 is provided with a suction pump (not shown) so that the inks remaining in the ejection nozzles can be replaced therefrom when the suction cap 23 is attached to the nozzle surfaces. Further, when the fabric printer 1 is not in a printing operation, the nozzle surfaces are covered by the suction cap 23 so that the inks in the nozzle surfaces can be prevented from being dried.

At a position toward the front from the guide rail 9, a clearance sensor 8, which extends in a direction substantially perpendicular to the front-rear direction, is provided. The clearance sensor 8 scans the surface of the fabric and detects an obstacle such as dust and a crease formed on the fabric set on the platen 5 when the platen 5 is carried along the rails 3 from a position at the downstream side to the upstream side of the rails 3 as the printing operation starts.

At right-hand front of the chassis 2 is provided an operation panel 28 to which a user inputs an instruction for the fabric printer 1. In an upper portion of the operation panel 28, various indicator lamps 174, a display 175, and various buttons 182 to input operations are provided (see FIG. 2).

Figure 2:
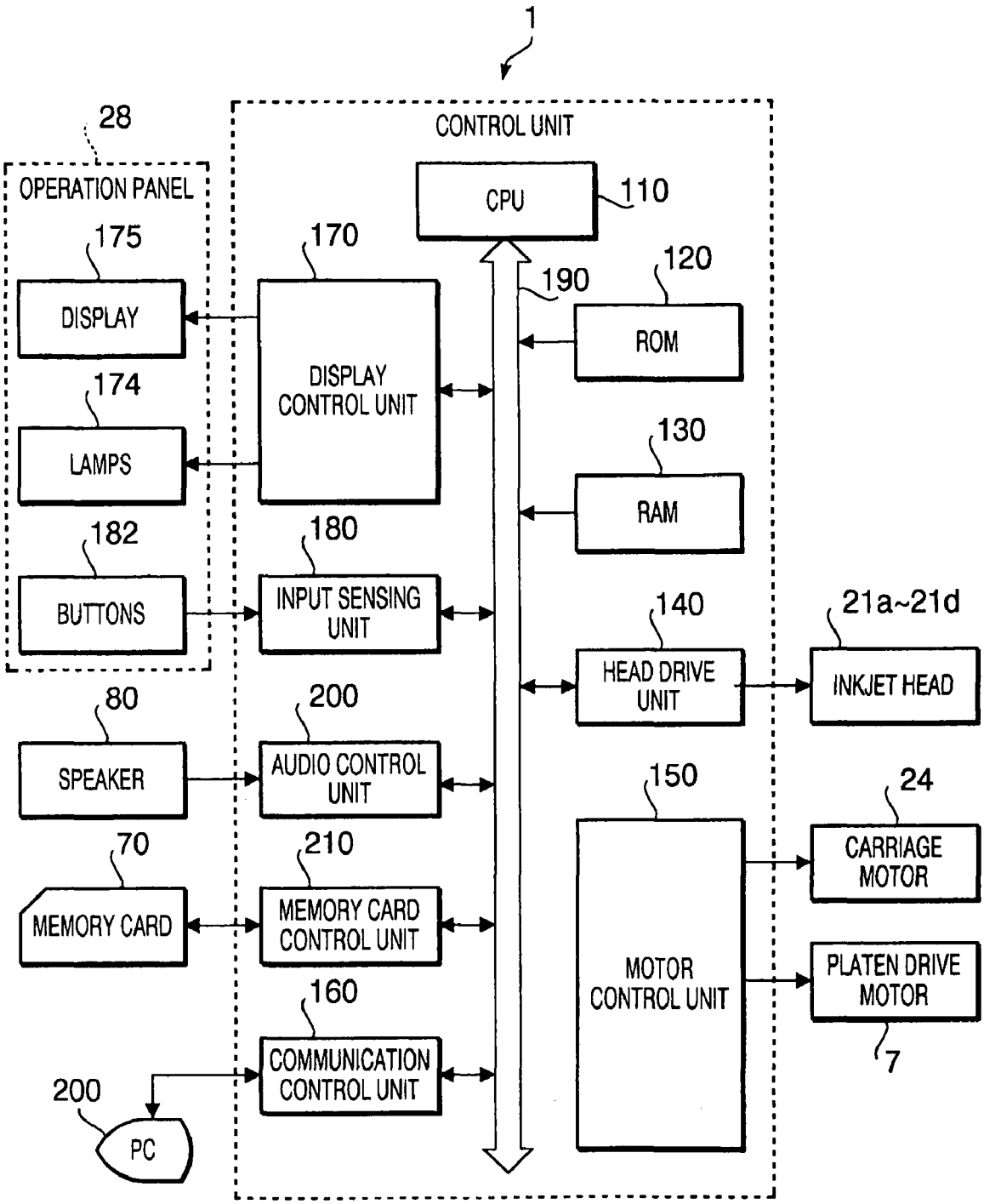
FIG. 2 is a block diagram to illustrate electrical configuration of the fabric printer 1 according to the embodiment of the present invention.

Next, referring to FIGS. 2-4, an electrical configuration of the fabric printer 1 will be described. FIG. 2 is a block diagram showing the electrical configuration of the fabric printer 1 according to the embodiment of the invention. FIG. 3 illustrates a configuration of a ROM 120 of the fabric printer 1 according to the embodiment of the invention. FIG. 4 illustrates a configuration of a RAM 130 of the fabric printer 1 according to the embodiment of the invention.

As shown in FIG. 2, the fabric printer 1 is provided with a CPU 110 that controls the entire operation in the fabric printer 1. The CPU 110 is connected with the ROM 120 and the RAM 130 via a bus 190.

The CPU 110 is connected with a head drive unit 140, which activates the piezoelectric actuators being provided to each channel of the inkjet heads 21*a*-21*d*, and a motor drive unit 150, which controls a carriage motor 24 and a platen drive motor 7. The carriage motor 24 drives the carriage 20 having the inkjet heads 21*a*-21*d*, and the platen drive motor 7 drives a platen roller (not shown), which adjusts timing and speeds to feed the platen 5 holding the a recording medium (i.e., the fabric).

The CPU 110 is connected with a display control unit 170 and an input detection unit 180. The display control unit 170 executes displaying processes of the display 175 and the indicator lamps 174, and the input detection unit 180 detects input through operation buttons 182, such as an operation to select and switch menus displayed on the display 175, start printing, a cancel printing, for example.

The CPU 110 is further connected with an audio control unit 200 and a memory card control unit 210 through the bus 190. The audio control unit 200 controls a speaker 80, from which an error sound and a notification sound to notify completion of a print job are reproduced. The memory card control unit 210 controls reading and writing operations to a memory card 70, which stores printable data.

Next, referring to FIG. 3, storing areas of the ROM 120 will be described. As shown in FIG. 3, the ROM 120 at least includes a program storing area 121 and an audio data storing area 122. The program storing area 121 stores various programs such as a controlling program to control operations of the fabric printer 1 and a print execution program to execute a printing operation. The audio data storing area 122 stores various audio data, which include data for notifying the user of an error, data for notifying the user of completion of a print job, data for prompting the user to exchange the platens, and data for notifying the user that no platen exchange is required.

Next, referring to FIG. 4, storing areas of the RAM 130 will be described. The RAM 130 in the fabric printer 1 is provided with several areas at least including a print job storing area 131 and a platen type storing area 132. The print job storing area 131 is for storing printable data transmitted from the personal computer 200 and obtained from the memory card 70 to be loaded in the fabric printer 1. The printable data for an image to be printed will be also referred to as a print job. The platen type storing area 132 stores a type of a platen to be used in the print job.

Next, referring to FIG. 5, a data structure of a print job will be described. FIG. 5 schematically illustrates the data structure of a print job 300 to be processed in the fabric printer 1 according to the embodiment of the present invention. The print job 300 includes a piece of attribute information 320, which indicates an attribute of the print data, and a piece of image information 330, which represents an image to be printed on the fabric. In addition to the attribute information 320 and the image information 330, a job head identifier 310 is provided at the head of the print job 300, while a job end identifier 340 is provided at the end of the print job 300. The job head identifier 330 and the job end identifier 340 are provided so that the head and the end of the print job 300 can be identified when the print job 300 is analyzed.

The attribute information 320 includes information indicating various parameters required for printing and analyzing the image represented by the image information 330 and information to be indicated on the operation panel 28. The attribute information 320 may indicate, for example, a graphics resolution 321, a platen type 322, a data name 323, and a number of copies 324 to be made. The platen type 322 is indicated by one of values, which respectively correspond to the exchangeable platens provided to the fabric printer 1. The types of the platens may include, for example, "10×12 inches," "14×16 inches," "for adult size," "for child size," "for size LL," "for size L," "for size M," "for size S," "for size SS," "for pocket," and "for sleeve." It is to be noted that the values to indicate the platen type 322 may be a character or a numeral as long as they can be recognized as types of the platens.

The image information 330 includes a graphic data 331 which represents the image to be printed. A data format of the graphic data 331 is defined by the fabric printer 1. Thus, the platen 5 to be used, indicated by the platen type 322, is associated with the image to be printed, represented by the graphic data 331, in the print job 300.

Next, with reference to FIG. 6, a printing process to be executed in the fabric printer 1 will be described. FIG. 6 is a flowchart to illustrate the printing process of the fabric printer 1 according to the embodiment of the present invention.

When the fabric printer 1 is powered on, the fabric printer 1 is initialized and waits for an input from the user. During the waiting period, when an input is detected by the input detection unit 180, in S1, it is determined as to whether the input is a pressing operation to a print start button. If the input was a pressing operation to the print start button (S1: YES), in S5, it is determined as to whether a print job is already loaded to be printed and stored in the print job storing area 131.

When the print job is not stored in the print job storing area 131 (e.g., immediately after the power-on operation) (S5: NO), printing is not initiated even if the print start button is pressed. Therefore, the CPU 110 repeats S1.

If the print job is loaded (S5: YES), in S10, an image is printed according to the information in the print job 300. When printing is completed, in S15, the platen type 322 indicated in the print job 300 is extracted and stored in the platen type storing area 132 in the RAM 130. It is to be noted that the platen type 322 may be stored in the platen type storing area 132 before the printing operation. Alternatively, the platen type 322 may be stored when the print job 300 is loaded in the print job storing area 131.

Meanwhile, in S1, if the input was not a pressing operation to the print start button (S1: NO), in S20, it is determined as to whether the input is an instruction to load the print job 300. If the input was not an instruction to load the print job 300 (S20: NO), in S50, other process is performed according to the input, and the fabric printer 1 returns to S1.

In S20, if the input was an instruction to load the print job 300 (S20: YES), in S25, the CPU 110 loads the print job 330 and stores the same in the print job storing area 131. The print job 330 to be loaded may be obtained from the PC 220 or from the memory card 70. Moreover, a recording medium to store the print job 300, which is to be loaded in the print job storing area 131, is not limited to a memory card, but may be other rewritable nonvolatile memory medium.

After completion of loading the print job 300, in S30, the platen type 322 indicated in the currently loaded print job 300 and the platen type 322 stored in the platen type storing area 132 in S15 in a previous printing operation are compared, and it is examined as to whether the two platen types are identical and consistent.

If it is judged that the two platen types are identical (S35: YES), it is determined the platen 5 currently mounted in the fabric printer 1 should not be replaced with another type of platen 5. Therefore, in S40, the CPU 110 reads the audio data representing that no exchange of the platen 5 with another platen is necessary from the audio data storing area 122 in the ROM 120 and generates the corresponding sound to be output from the speaker 80. Thus, completion of loading the print job 300 is presented and indication "no exchange necessary" is presented to the user. The sound output from the speaker 80 may be, for example, a voice message to inform the user that the platen currently mounted in the fabric printer 1 is correct and no exchange of the platens is necessary. Thereafter, the CPU 110 waits for an input from the user and repeats S1.

Meanwhile, in S35, if it is judged that the two platen types are not identical (S35: NO), it is determined the platen 5 currently mounted in the fabric printer 1 should be replaced with another platen which is suitable for the current print job 300. Therefore, in S45, the CPU 110 reads the audio data representing that exchange of the platen 5 with another platen is necessary from the audio data storing area 122 in the ROM 120 and generates the corresponding sound to be output from the speaker 80. Thus, completion of loading the print job 300 is acknowledged and indication "exchange of platens necessary" is presented to the user. The sound output from the speaker 80 may be, for example, a voice message to inform the user that the platen currently mounted in the fabric printer is incorrect and replacement is required. Thereafter, the CPU 110 waits for an input from the user and repeats S1.

According to the present embodiment, if the printing process is performed for the first time and/or after the platen type storing area 132 is initialized, in S35, negative judgment is made (S35: NO), and the process proceeds to S45 to generate the sound indication "exchange of platens necessary." However, in another embodiment, the process may proceeds to S40 to generate the sound indication "no exchange is necessary" is presented to the user.

As described above, with the fabric printer 1 according to the embodiment of the present invention, the type of the platen indicated (used) in the print job 300 is automatically stored upon completion of a printing operation. When a new print job 300 is loaded, the type of the platen to be used (as indicated in the newly loaded print job 300) is compared with the type of the previously used platen. Two different indication sounds are prepared, and one of the two sounds is selectively output according to necessity/no necessity of exchanging the platens upon completion of loading the print job. Therefore, the user can be notified of completion of loading the print job as well as necessity of exchanging the platens without a specific mechanism to detect the types of the platens such as a sensor. Accordingly, failure in forming an image due to a platen of an incorrect type can be easily prevented.

Although an example of carrying out the invention has been described, those skilled in the art will appreciate that there are numerous variations and permutations of the printing apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the platen type storing area 132 may be provided in other rewritable nonvolatile memory than the ROM 120, such as a flash memory and an EEPROM.

For another example, the audio data to notify the user of completion of loading the print job 300 and necessity/no necessity of exchanging the platens is not necessarily stored in the audio data storing area 122 in the ROM 120. The notification sounds is not necessarily be represented by data but may be automatically generated by a program.

Moreover, for example, in S35, if it is determined that the platen type 322 indicated in the currently loaded print job 300 and the platen type stored in the platen type storing area 132 in S15 in a previous printing operation are consistent, the "no necessity of exchanging the platens" sound may not be necessarily output. The user may be notified of the necessity of exchanging the platens only when the two platen types are different and inconsistent, and the user can be notified of "no necessity of exchanging the platens" by silence when the two platen types are identical.

Further, for example, the indication to notify the user of necessity of exchanging the platens may include information concerning the platen to replace the platen 5 which is currently being mounted.

Furthermore, necessity/no necessity of exchanging the platens is not necessarily notified to the user by sounds, but may be notified by one or more of switching on/off of the indicator lamps 174 and indication of a message, an image, and the like on the display 175, etc.

Furthermore, notification can be provided when the print job 300 is obtained from the PC 200 or the memory card 70 and before the obtained print job 300 is loaded in the print job storing area 131. Optionally, the print job storing area 131 may be configured to be capable of storing a plurality of print jobs. In such a configuration, one of the plurality of print jobs stored in the print job storing area 131 can be selectively or automatically processed for the printing operation. Notification concerning the type of the platen can be provided when the one of the print jobs 300 is committed to be processed in the printing operation.

What is claimed is:

1. A printing apparatus for forming an image on a piece of fabric, comprising:

a plurality of types of exchangeable fabric holders, one of which is selectively mounted in the printing apparatus to hold the fabric;

a recording head, which is driven to eject ink onto the fabric according to printable data, the printable data including image information representing the image to be printed and holder information concerning a type of the fabric holder to be used for forming the image in the printing apparatus;

an obtaining unit to obtain the printable data from external environment;

a storage unit with a storage area to store the holder information extracted from the printable data;

an examination unit to examine as to whether the holder information included in printable data to be used in a current printing operation is identical with the holder information extracted from the printable data used in a previous printing operation and stored in the storage area; and an indication unit, which indicates a result of the examination obtained by the examination unit to notify a user of the printing apparatus of necessity of exchanging the fabric holders when the fabric holder to be used in the current printing operation is different from the fabric holder used in the previous printing operation.

2. The printing apparatus according to claim 1, wherein the examination unit examines the two pieces of holder information when the obtaining unit obtains the printable data from an external device.

3. The printing apparatus according to claim 1, wherein the examination unit examines the two pieces of holder information when the printable data obtained from an external device is committed to be processed in the current printing operation.

4. The printing apparatus according to claim 1, further comprising:

an instruction unit, through which an instruction to start the current printing operation from the user is provided to the printing apparatus, wherein the examination unit examines the two pieces of holder information when the instruction from the user is provided to the printing apparatus through the instruction unit.

5. The printing apparatus according to claim 1, wherein the indication of the result of the examination is presented by at least one of sound, illumination, and image-displaying.

6. The printing apparatus according to claim 1, wherein the indication unit indicates the result of the examination when the holder information in the printable data to be used in the current printing operation is identical with the holder information extracted from the printable data used in the previous printing operation and stored in the storage area.

7. A method to provide indication concerning necessity of replacing a fabric holder used in a previous printing operation with a fabric holder to be used in a current printing operation to a user of a printing apparatus having a plurality of types of exchangeable fabric holders, by executing steps of:

obtaining printable data, which includes image information representing an image to be printed and holder information concerning a type of the fabric holder to be used for forming the image in the printing apparatus, from external environment;

extracting the holder information from the printable data to store in a storage area of a storage unit;

examining as to whether the holder information included in the printable data to be used in the current printing operation is identical with the holder information extracted from the printable data used in a previous printing operation and stored in the storage area; and indicating a result of the examination to notify the user of necessity of exchanging the fabric holders when the fabric holder to be used in the current printing operation is different from the fabric holder used in the previous printing operation.

8. A computer usable medium comprising computer readable instructions to control a printing apparatus having a plurality of types of exchangeable fabric holders to provide a user with indication concerning necessity of exchanging the fabric folders, by executing steps of:

obtaining printable data, which includes image information representing an image to be printed and holder information concerning a type of the fabric holder to be used for forming the image in the printing apparatus, from external environment;

extracting the holder information to store in a storage area of a storage unit;

examining as to whether the holder information included in the printable data to be used in a current printing operation is identical with the holder information extracted from the printable data used in a previous printing operation and stored in the storage area; and indicating a result of the examination to notify the user of necessity of exchanging the fabric holders when the fabric holder to be used in the current printing operation is different from the fabric holder used in the previous printing operation.

* * * * *